US011242781B2

(12) United States Patent
Suzuki et al.

(10) Patent No.: US 11,242,781 B2
(45) Date of Patent: Feb. 8, 2022

(54) AIR EXHAUSTING DEVICE

(71) Applicant: SUZUKI MOTOR CORPORATION, Hamamatsu (JP)

(72) Inventors: Kenta Suzuki, Hamamatsu (JP); Suguru Mori, Hamamatsu (JP); Hiromitsu Tonooka, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 605 days.

(21) Appl. No.: 16/116,420

(22) Filed: Aug. 29, 2018

(65) Prior Publication Data

US 2019/0063281 A1 Feb. 28, 2019

(30) Foreign Application Priority Data

Aug. 30, 2017 (JP) ..... JP2017-166056

(51) Int. Cl.
*F01N 1/02* (2006.01)
*F01N 1/08* (2006.01)
(Continued)

(52) U.S. Cl.
CPC ..... *F01N 1/02* (2013.01); *F01N 1/083* (2013.01); *F01N 1/084* (2013.01); *F01N 1/089* (2013.01);
(Continued)

(58) Field of Classification Search
CPC . F01N 1/02; F01N 1/084; F01N 1/089; F01N 13/007; F01N 13/08;
(Continued)

(56) References Cited

U.S. PATENT DOCUMENTS 4,177,875 A * 12/1979 Kurobe ..... F01N 1/02 181/265
4,846,228 A * 7/1989 Blanscet ..... F16L 55/0279 138/26
(Continued)

FOREIGN PATENT DOCUMENTS

CN 102733891 A 10/2012
CN 204716364 U 10/2015
(Continued)

OTHER PUBLICATIONS

Examination Report issued in corresponding Indian Patent Application No. 201814022358 dated Oct. 25, 2019.
(Continued)

*Primary Examiner* — Jeremy A Luks
(74) *Attorney, Agent, or Firm* — Troutman Pepper Hamilton Sanders LLP

(57) ABSTRACT

An air exhausting device includes a muffler internally divided into a plurality of chambers by a separator, an inlet pipe that couples an exhaust pipe of an engine to the muffler, and an outlet pipe that is a path to discharge an exhaust gas inside the muffler to outside air. The muffler is configured of an expansion chamber to which a downstream end of the inlet pipe opens, and a resonator chamber communicated with only the expansion chamber via a plurality of resonator pipes. Any of or both of lengths and thicknesses of the plurality of resonator pipes are different.

2 Claims, 2 Drawing Sheets

(51) Int. Cl.
*F01N 13/00* (2010.01)
*F01N 13/08* (2010.01)

(52) U.S. Cl.
CPC ..... *F01N 13/007* (2013.01); *F01N 13/08* (2013.01); *F01N 2210/04* (2013.01); *F01N 2470/00* (2013.01); *F01N 2490/02* (2013.01); *F01N 2490/06* (2013.01); *F01N 2490/10* (2013.01); *F01N 2590/04* (2013.01)

(58) Field of Classification Search
CPC ..... F01N 2210/04; F01N 2470/00; F01N 2470/14; F01N 2490/02; F01N 2490/06; F01N 2590/04
USPC ..... 181/253, 265
See application file for complete search history.

(56) References Cited

U.S. PATENT DOCUMENTS 5,602,368 A * 2/1997 Kaneso ..... F01N 1/003 181/250
5,614,699 A * 3/1997 Yashiro ..... F01N 1/02 181/254
5,971,098 A * 10/1999 Suzuki ..... F01N 1/02 181/254
7,063,182 B2 * 6/2006 Proctor ..... F01N 1/02 181/249
8,991,553 B2 * 3/2015 Wakatsuki ..... F01N 1/08 181/268
2004/0050618 A1 3/2004 Marocco

FOREIGN PATENT DOCUMENTS

JP 59162318 A * 9/1984 ..... F01N 13/1838
JP 2002-235522 A 8/2002
JP 2010255514 A 11/2011

OTHER PUBLICATIONS

Chinese Office Action issued in corresponding Chinese Patent Application No. 201810907333.0 dated May 27, 2020, with machine translation.

* cited by examiner

AIR EXHAUSTING DEVICE

CROSS-REFERENCE TO RELATED APPLICATIONS

This application is based upon and claims the benefit of priority of the prior Japanese Patent Application No. 2017-166056, filed on Aug. 30, 2017, the entire contents of which are incorporated herein by reference.

BACKGROUND OF THE INVENTION

Field of the Invention

The present invention typically relates to an air exhausting device coupled to an engine mounted on a motorcycle.

Description of the Related Art

Conventionally, for example, an air exhausting device disclosed in Patent Document 1 includes an exhaust pipe coupled to an exhaust port of an engine, and a muffler coupled to a downstream side of the exhaust pipe. The muffler is internally divided into a plurality of chambers by a separator. A plurality of resonators are disposed inside the muffler.

Patent Document 1: Japanese Laid-open Patent Publication No. 2010-255514

The conventional example as described above includes a plurality of resonators. However, its silencing function is limited.

SUMMARY OF THE INVENTION

To solve the actual conditions, an object of the present invention is to provide an air exhausting device configured to provide an excellent silencing function.

An air exhausting device of the present invention includes a muffler internally divided into a plurality of chambers by a separator, an inlet pipe that couples an exhaust pipe of an engine to the muffler, and an outlet pipe that is a path to discharge an exhaust gas inside the muffler to outside air. The muffler is configured of an expansion chamber to which a downstream end of the inlet pipe opens, and a resonator chamber communicated with only the expansion chamber via a plurality of resonator pipes. Any of or both of lengths and thicknesses of the plurality of resonator pipes are different.

DETAILED DESCRIPTION OF THE PREFERRED EMBODIMENTS

The following describes preferred embodiments of an air exhausting device according to the present invention based on the drawings. An air exhausting device built into an engine of a motorcycle is exemplified as an application example of the present invention.

An air exhausting device according to one embodiment of the present invention includes a muffler internally divided into a plurality of chambers by a separator, an inlet pipe that couples an exhaust pipe of an engine to the muffler, and an outlet pipe that is a path to discharge an exhaust gas inside the muffler to outside air. The muffler is configured of an expansion chamber to which a downstream end of the inlet pipe opens, and a resonator chamber communicated with only the expansion chamber via a plurality of resonator pipes. Any of or both of lengths and thicknesses of the plurality of resonator pipes are different.

In the air exhausting device of the present invention, differentiating any of or both of the lengths and the thicknesses of the plurality of resonator pipes ensures expansion in a frequency range of the exhaust noise that can obtain the silencing effect, thus improving a silencing function of the air exhausting device.

First Embodiment

Figure 1:
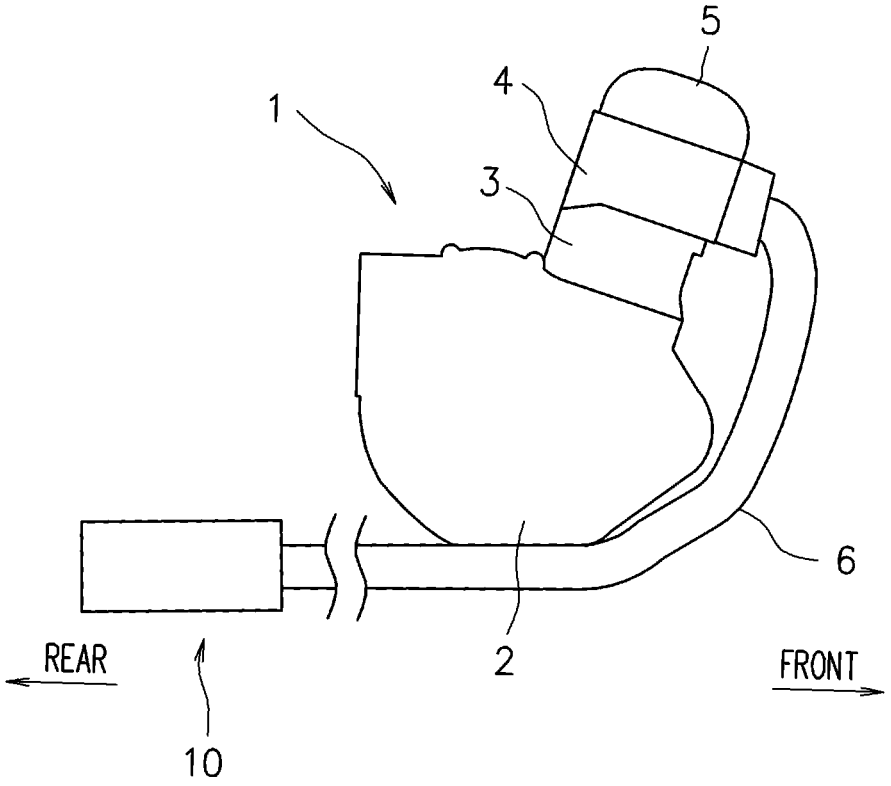
FIG. 1 is a right side view illustrating a periphery of an air exhausting device built into an engine of a motorcycle as an application example of the present invention.

Including FIG. 1, drawings referred to in the following description define a direction that a rider who has ridden a motorcycle views a front of the vehicle as a front and a direction opposite to the front as a rear. The right side of the rider is defined as the right and the left side as the left. These respective directions are appropriately indicated by arrows as necessary. FIG. 1 is a right side view illustrating a periphery of an air exhausting device 10 built into an engine 1 mounted on a motorcycle as an application example of the present invention.

The motorcycle including the air exhausting device 10 in this embodiment forms a framework of vehicle body with a vehicle body frame made of steel, aluminum alloy, and the like. In FIG. 1, this vehicle body frame supports the engine 1 at an approximately center of the vehicle body. The engine 1 is, for example, a four-cycle single cylinder (may be a two-cylinder or more) engine. The engine 1 may be a water-cooled engine or an air-cooled engine. This engine 1 has a basic configuration including a crankcase 2 and a cylinder block 3. The crankcase 2 rotatably supports and houses a crankshaft arranged horizontally in a right-left direction. The cylinder block 3 is coupled with an upper portion of the crankcase 2 and has an axis line that is appropriately inclined ahead to be set in an approximately vertical direction. The engine 1 is configured further including a cylinder head 4 and a cylinder head cover 5. The cylinder head 4 is coupled with an upper portion of the cylinder block 3. The cylinder head cover 5 is attached to and lids the cylinder head 4.

The engine 1 includes an air intake system where air purified by an air cleaner (not illustrated) is supplied to the engine 1 via an intake passage. In this case, a mixture at a predetermined mixing ratio formed of air and fuel is supplied from a throttle body arranged on the middle of the intake passage to an intake port (not illustrated) disposed on a back portion of the cylinder head 4. A combustion gas that has exploded and combusted inside the cylinder block 3 of the engine 1 in an exhaust system is discharged from the engine 1. That is, the combustion gas generated inside the engine 1, as an exhaust gas, passes through an exhaust pipe 6 coupled to an exhaust port (not illustrated) of the engine 1. Then, the combustion gas is discharged to the outside air from the air exhausting device 10 coupled to the exhaust pipe 6.

Figure 2:
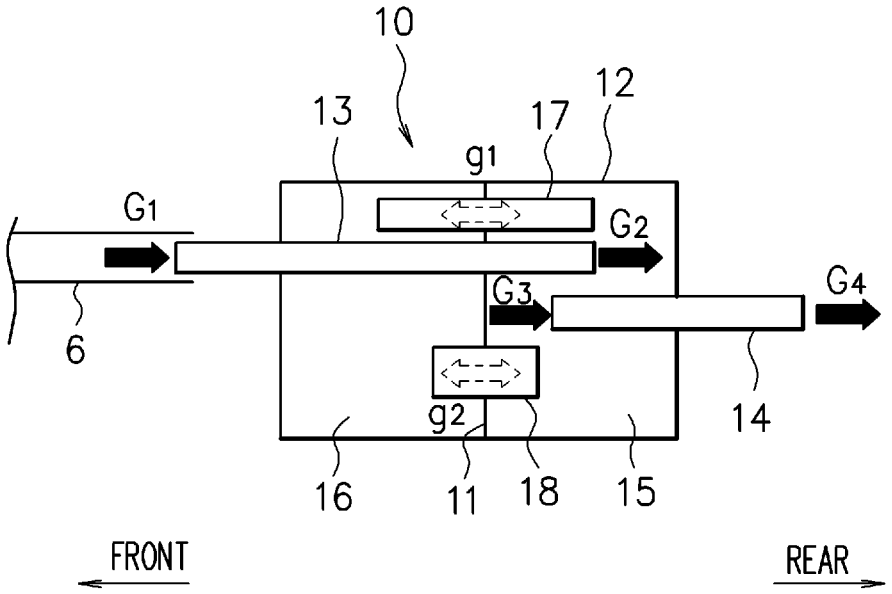
FIG. 2 is a cross-sectional view along a longitudinal direction schematically illustrating an exemplary internal structure of an air exhausting device in a first embodiment of the present invention.

Next, FIG. 2 is a cross-sectional view along a longitudinal direction schematically illustrating an exemplary internal structure of the air exhausting device 10. The air exhausting device 10 includes a muffler 12, an inlet pipe 13, and an outlet pipe 14. The muffler 12 is internally divided into a plurality of chambers described below by a separator 11. The inlet pipe 13 couples the exhaust pipe 6 of the engine 1 to the muffler 12. The outlet pipe 14 is a path to discharge the exhaust gas inside the muffler 12 to the outside air.

In this embodiment, the muffler 12 is divided into an expansion chamber 15 and a resonator chamber 16 by the separator 11.

The muffler 12 is constituted of the expansion chamber 15 and the resonator chamber 16. The inlet pipe 13 has a downstream end that opens to the expansion chamber 15. The resonator chamber 16 is communicated with only the expansion chamber 15, via a plurality of resonator pipes 17 and 18. Any of or both of lengths and thicknesses of the resonator pipes 17 and 18 are different one another.

In the above-described case, as the example illustrated in FIG. 2, the length of the resonator pipe 17 is set longer than the length of the resonator pipe 18. The thickness of the resonator pipe 17 is set thinner than the thickness of the resonator pipe 18. Not only the case where both of the lengths and the thicknesses of the resonator pipes 17 and 18 are different as this example, but also a case where only their lengths are different and a case where only their thicknesses are different are included. As a way to differentiate the lengths and the thicknesses of the resonator pipes 17 and 18, any one may be set longer, or any one may be set thicker.

With reference to FIG. 2, in the air exhausting device 10 of the present invention, the combustion gas generated inside the engine 1, as the exhaust gas, flows from the exhaust pipe 6 as an arrow $G_1$ via the inlet pipe 13 into the expansion chamber 15 (an arrow $G_2$). The exhaust gas that has flowed into the expansion chamber 15 passes through the outlet pipe 14 as an arrow $G_3$ to be discharged to the outside air from the air exhausting device 10 (an arrow $G_4$).

The resonator chamber 16 is a closed space. In the resonator pipes 17 and 18 coupled to the resonator chamber 16, a pressure of the exhaust gas pulsates as respective arrow $g_1$ and arrow $g_2$ by pressure variation of the exhaust gas inside the expansion chamber 15. Having the single resonator chamber 16 communicated with only the expansion chamber 15 via the resonator pipes 17 and 18 ensures high silencing effect against exhaust noise with a simple configuration. In this case, differentiating any of or both of the lengths and the thicknesses of the plurality of resonator pipes 17 and 18 ensures expansion in a frequency range of the exhaust noise that can obtain the silencing effect, thus improving a silencing function of the air exhausting device 10. If a single resonator pipe was used, it is only possible to obtain the silencing effect against the exhaust noise at a limited specific frequency.

The first embodiment of the present invention has described the example including the two resonator pipes 17 and 18. However, it is also possible to include three or more resonator pipes. In this case, any of or both of lengths and thicknesses of these resonator pipes are differentiated.

Second Embodiment

Figure 3:
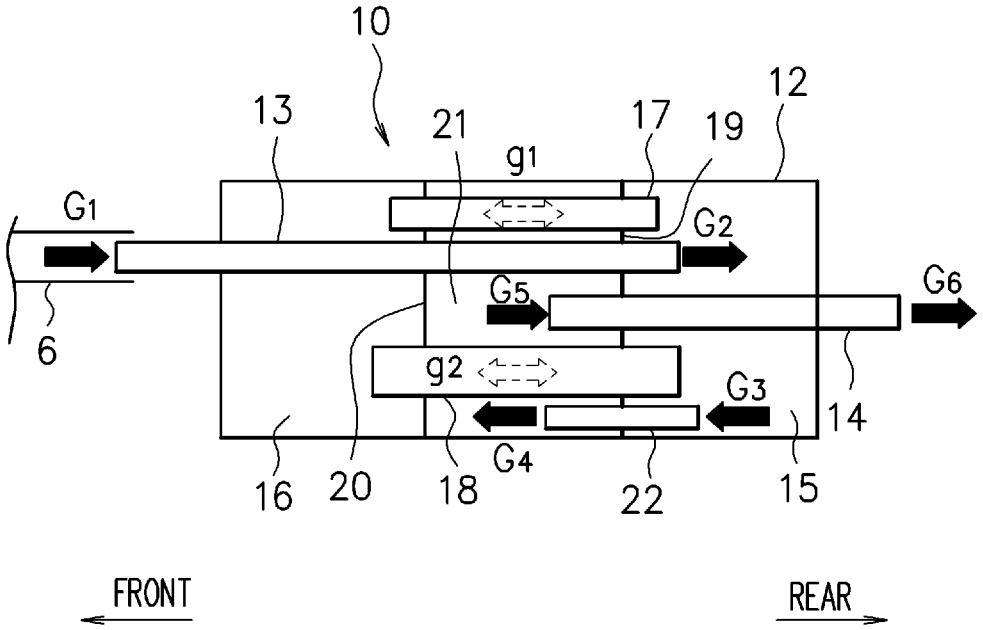
FIG. 3 is a cross-sectional view along a longitudinal direction schematically illustrating an exemplary internal structure of an air exhausting device in a second embodiment of the present invention.

The following describes a second embodiment of the air exhausting device according to the present invention. FIG. 3 is a cross-sectional view along a longitudinal direction schematically illustrating an exemplary internal structure of an air exhausting device 10 in the second embodiment. Members identical to or corresponding to those in the first embodiment are described using identical reference numerals. In the second embodiment, the air exhausting device 10 includes the muffler 12, the inlet pipe 13, and the outlet pipe 14. The muffler 12 is internally divided into a plurality of chambers described below by separators 19 and 20. The inlet pipe 13 couples the exhaust pipe 6 of the engine 1 to the muffler 12. The outlet pipe 14 is a path to discharge the exhaust gas inside the muffler 12 to the outside air.

The muffler 12 includes the expansion chamber 15 and the resonator chamber 16. The inlet pipe 13 has a downstream end that opens to the expansion chamber 15. The resonator chamber 16 is communicated with only the expansion chamber 15, via the plurality of resonator pipes 17 and 18. Any of or both of lengths and thicknesses of the resonator pipes 17 and 18 are different one another.

In the second embodiment of the present invention, especially, an outlet expansion chamber 21 is arranged adjacent to the expansion chamber 15 across the separator 19. The resonator chamber 16 is arranged adjacent to the outlet expansion chamber 21 across the separator 20.

Further, the outlet pipe 14 is communicated with the outlet expansion chamber 21. The expansion chamber 15 is communicated with the outlet expansion chamber 21 via a communication pipe 22.

With reference to FIG. 3, in the air exhausting device 10 in the second embodiment of the present invention, the combustion gas generated inside the engine 1, as the exhaust gas, flows from the exhaust pipe 6 as an arrow $G_1$ via the inlet pipe 13 into the expansion chamber 15 (an arrow $G_2$). The exhaust gas that has flowed into the expansion chamber 15 passes through the communication pipe 22 as an arrow $G_3$ to flow into the outlet expansion chamber 21 (an arrow $G_4$). Further, the exhaust gas that has flowed into the outlet expansion chamber 21 passes through the outlet pipe 14 as an arrow $G_5$ to be discharged to the outside air from the air exhausting device 10 (an arrow $G_6$).

At this time, in the resonator pipes 17 and 18 coupled to the resonator chamber 16 that is a closed space, a pressure of the exhaust gas pulsates as respective arrow $g_1$ and arrow $g_2$ by pressure variation of the exhaust gas inside the expansion chamber 15.

In the air exhausting device 10 in the second embodiment, having the resonator chamber 16 communicated with the expansion chamber 15 via the resonator pipes 17 and 18 ensures the silencing effect against the exhaust noise. Also in this case, differentiating any of or both of the lengths and the thicknesses of the plurality of resonator pipes 17 and 18 ensures the expansion in the frequency range of the exhaust noise that can obtain the silencing effect, thus improving the silencing function of the air exhausting device 10.

The exhaust gas that has flowed into the expansion chamber 15 flows into the outlet expansion chamber 21 via the communication pipe 22, and then, passes through the outlet pipe 14 from the outlet expansion chamber 21 to be discharged to the outside air from the air exhausting device 10. That is, the exhaust gas substantially passes through only the two expansion chamber 15 and outlet expansion chamber 21 from the inlet pipe 13. Accordingly, compared with, for example, a conventionally known case of a three-chamber-inversion structure where a muffler is internally divided into three chambers, improvement in engine output is ensured as a result by effectively decreasing the pressure of the exhaust gas inside the muffler 12.

The outlet expansion chamber 21 is arranged between the expansion chamber 15 and the resonator chamber 16, and the plurality of resonator pipes 17 and 18 are disposed across the outlet expansion chamber 21. Then, the lengths of these resonator pipes 17 and 18 are easily ensured. This effectively contributes to the expansion in the frequency range of the controllable exhaust noise.

While the present invention has been described using various embodiments above, the present invention is not limited only to these embodiments. Changes and similar modification are possible within the scope of the present invention.

For example, the numbers of the plurality of resonator pipes 17 and 18 in the above-described embodiment, or their lengths and thicknesses are appropriately settable as necessary.

The present invention functions as an air exhausting device with respect to an engine mounted on another vehicle and the like similarly to the above description, not limited to the engine mounted on the motorcycle.

With the present invention, the plurality of resonator pipes coupled to the resonator chamber provide the silencing function corresponding to a plurality of frequencies.

What is claimed is:

1. An air exhausting device comprising:

a muffler;

an inlet pipe that couples an exhaust pipe of an engine to the muffler; and an outlet pipe that is a path to discharge an exhaust gas inside the muffler, wherein the muffler is divided into a resonator chamber, an outlet expansion chamber arranged adjacent to the resonator chamber, and an expansion chamber arranged adjacent to the outlet expansion chamber by two separators, in an order from closest to furthest from the engine, a downstream end of the inlet pipe opens to the expansion chamber, the outlet expansion chamber is communicated with the expansion chamber via a communication pipe, and an upstream end of the outlet pipe arranged in parallel with the inlet pipe opens to the outlet expansion chamber, and the resonator chamber is communicated with only the expansion chamber via a plurality of resonator pipes, and any of or both of lengths and thicknesses of the plurality of resonator pipes are different.

2. The air exhausting device according to claim 1, wherein the inlet pipe, the plurality of resonator pipes, and the communication pipe are provided in parallel in the expansion chamber, and the downstream end of the inlet pipe, upstream ends of the plurality of resonator pipes, and an upstream end of the communication pipe protrude at a same side in the expansion chamber.

* * * * *